US012768295B2

(12) United States Patent
Sakai et al.

(10) Patent No.: US 12,768,295 B2
(45) Date of Patent: Oct. 20, 2026

(54) METHOD AND DEVICE FOR DETECTING PRESSURE DIFFERENCE OF PARTICULATE FILTER

(71) Applicant: NISSAN MOTOR CO., LTD., Yokohama (JP)

(72) Inventors: Akikazu Sakai, Kanagawa (JP); Hideyuki Suzuki, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 130 days.

(21) Appl. No.: 18/870,110

(22) PCT Filed: Jun. 2, 2022

(86) PCT No.: PCT/JP2022/022409
§ 371 (c)(1),
(2) Date: Nov. 27, 2024

(87) PCT Pub. No.: WO2023/233605
PCT Pub. Date: Dec. 7, 2023

(65) Prior Publication Data

US 2026/0251084 A1 Aug. 27, 2026

(51) Int. Cl.
*F01N 11/00* (2006.01)
*F01N 9/00* (2006.01)

(52) U.S. Cl.
CPC ..... *F01N 11/002* (2013.01); *F01N 9/002* (2013.01); *F01N 2550/04* (2013.01);
(Continued)

(58) Field of Classification Search
CPC .... F01N 11/002; F01N 9/002; F01N 2550/04; F01N 2560/08; F01N 2560/14; F01N 2900/1406
See application file for complete search history.

(56) References Cited

U.S. PATENT DOCUMENTS

2005/0217256 A1* 10/2005 Okugawa ..... F01N 13/009 60/285
2006/0021334 A1* 2/2006 Kuboshima ..... F01N 9/002 60/297

(Continued)

FOREIGN PATENT DOCUMENTS

JP 2002-371827 A 12/2002
JP 2007-292013 A 11/2007
WO WO-2013/005456 A1 1/2013

*Primary Examiner* — Hoang M Nguyen
(74) *Attorney, Agent, or Firm* — Foley & Lardner LLP

(57) ABSTRACT

A particulate filter differential pressure sensing method is provided. The method includes sensing, by an upstream pressure sensor, a first pressure on an upstream side of a particulate filter disposed in an exhaust passage of an internal combustion engine; sensing, by a downstream pressure sensor, a second pressure on a downstream side of the particulate filter; and calculating an upstream-to-downstream differential pressure of the particulate filter. The method further includes correcting a sensed value of the first pressure or the second pressure so as to reduce a difference in waveform phase between the first pressure and the second pressure; and implementing the calculation of the upstream-to-downstream differential pressure based on the corrected sensed value of the first pressure or the second pressure.

10 Claims, 3 Drawing Sheets

(52) U.S. Cl.
CPC ..... *F01N 2560/08* (2013.01); *F01N 2560/14* (2013.01); *F01N 2900/1406* (2013.01)

(56) References Cited

U.S. PATENT DOCUMENTS

| | | | | |
|---|---|---|---|---|
| 2007/0131193 | A1* | 6/2007 | Takahashi | F01M 1/18<br>123/196 AB |
| 2007/0251214 | A1 | 11/2007 | Nishino et al. | |
| 2012/0186235 | A1* | 7/2012 | Yamamoto | F02D 41/025<br>60/274 |
| 2014/0033680 | A1* | 2/2014 | Swoish | F02D 41/1445<br>73/114.71 |
| 2014/0223998 | A1 | 8/2014 | Yamakawa et al. | |

* cited by examiner

METHOD AND DEVICE FOR DETECTING PRESSURE DIFFERENCE OF PARTICULATE FILTER

TECHNICAL FIELD

The present invention relates to a method and a device for sensing an upstream-to-downstream differential pressure of a particulate filter (GPF or DPF) disposed in an exhaust passage of an internal combustion engine.

BACKGROUND ART

An engine, which may be a gasoline engine or diesel engine, may be provided with a particulate filter for removing particulates contained in exhaust gas. A patent document 1 discloses that a differential pressure sensor is employed to sense an upstream-to-downstream differential pressure of a particulate filter disposed in an exhaust passage, in order to control a process of regeneration against clogging of the particulate filter or in order to estimate damage to the particulate filter. The patent document 1 also discloses that an error in an average value of the differential pressure, which is caused by exhaust pressure pulsation, is corrected using a correction value that is determined using a map defined by a required engine torque and an engine speed.

However, the patent document 1 does not take account of a phase difference between a pressure waveform of an upstream pressure of the particulate filter and a pressure waveform of a downstream pressure of the particulate filter. Although the upstream pressure and the downstream pressure both change in response to exhaust pulsation, the upstream pressure and the downstream pressure have phases that do not necessarily coincide with each other. For example, if, in an exhaust passage equipped with a particulate filter, a path from an outlet of the upstream pressure to the differential pressure sensor and a path from an outlet of the downstream pressure to the differential pressure sensor are different in path length from each other, a relatively large phase difference may occur between the pressure waveform of the upstream pressure and the pressure waveform of the downstream pressure (for example, see FIG. 3). The phase difference may cause a differential pressure occurs between the upstream pressure and the downstream pressure. Specifically, as is clear from FIG. 3, microscopically, the upstream-to-downstream differential pressure changes significantly while reversing between positive and negative, which is a factor for adversely affecting the accuracy of measurement of the upstream-to-downstream differential pressure.

PRIOR ART DOCUMENT(S)

Patent Document(s)

Patent Document 1: Japanese Patent Application Publication No. 2002-371827

SUMMARY OF INVENTION

According to the present invention, a particulate filter differential pressure sensing method includes: sensing by an upstream pressure sensor a first pressure on an upstream side of a particulate filter disposed in an exhaust passage of an internal combustion engine; sensing by a downstream pressure sensor a second pressure on a downstream side of the particulate filter; calculating an upstream-to-downstream differential pressure of the particulate filter; correcting a sensed value of the first pressure or the second pressure so as to reduce a difference in waveform phase between the first pressure and the second pressure; and implementing the calculation of the upstream-to-downstream differential pressure based on the corrected sensed value of the first pressure or the second pressure.

The application of the correction corresponding to the phase difference serves to eliminate or suppress components of the upstream-to-downstream differential pressure caused by the phase difference. Therefore, even if a pipe for the upstream pressure sensor and a pipe for the downstream pressure sensor are different in path length from each other, the upstream-to-downstream differential pressure of the particulate filter can be calculated with high accuracy.

MODE(S) FOR CARRYING OUT INVENTION

Figure 1:
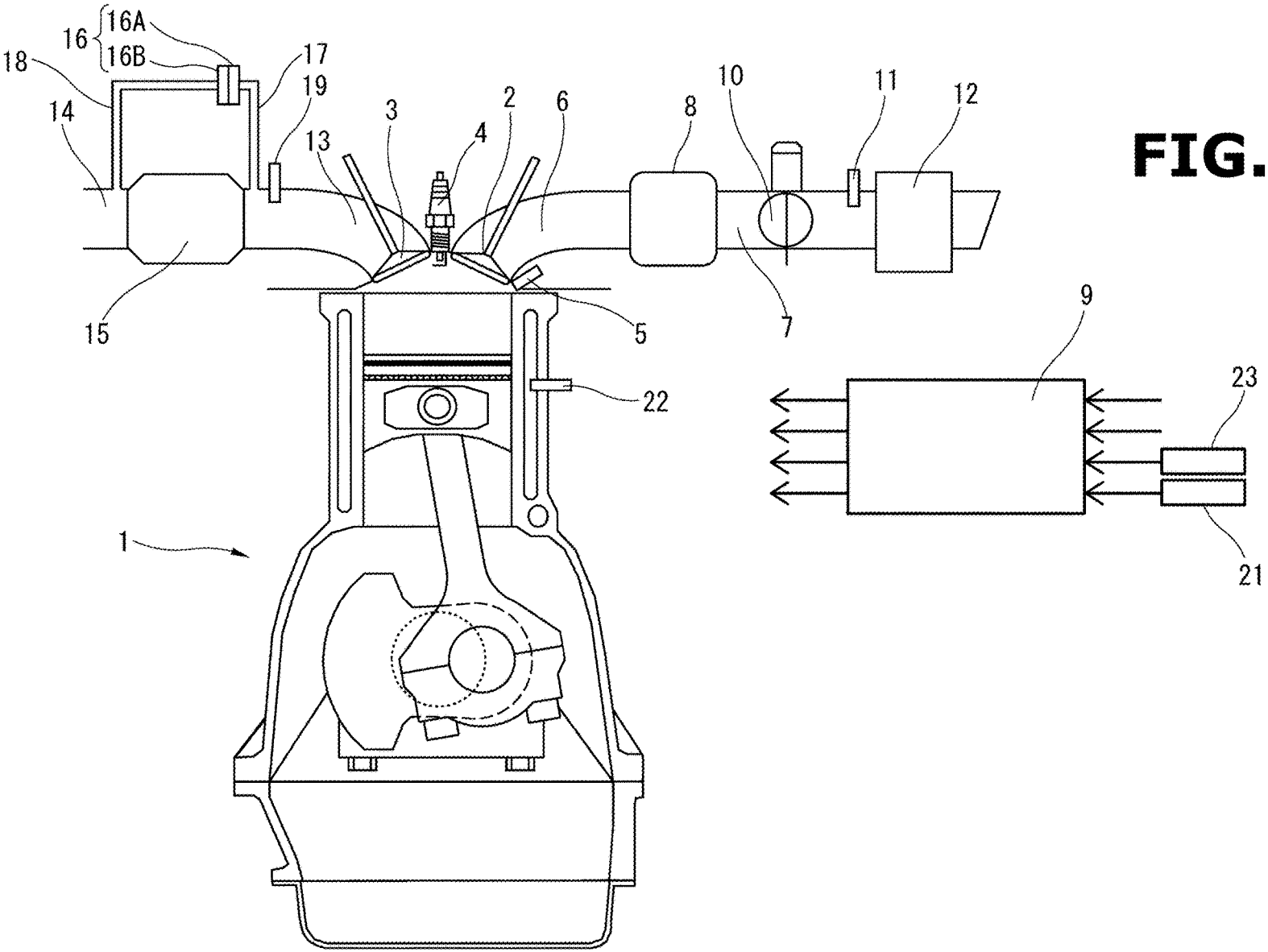
FIG. 1 is a diagram illustrating a configuration of an internal combustion engine equipped with a particulate filter according to an embodiment.

The following describes an embodiment of the present invention in detail with reference to the drawings. FIG. 1 is an explanatory diagram showing a schematic configuration of an internal combustion engine 1 according to the embodiment of the present invention. The internal combustion engine 1 is a four-stroke cycle spark ignition internal combustion engine (so-called gasoline engine), and includes cylinders each of which is provided with an intake valve 2, an exhaust valve 3, and an ignition plug 4. In the illustrated example, the internal combustion engine 1 is configured as an incylinder direct injection type in which a fuel injection valve 5 is arranged closer to the intake valve 2 for injecting fuel into the cylinder. Alternatively, the internal combustion engine 1 may be configured as a port injection type in which fuel is injected toward an intake port 6.

An electronically controlled throttle valve 10 is interposed upstream of a collector section 8 of an intake passage 7 which is connected to the intake port 6 of each cylinder. The opening of the throttle valve 10 is controlled by a control signal from an engine controller 9. An airflow meter 11 is disposed upstream of the throttle valve 10 for sensing a quantity of intake air. An air cleaner 12 is disposed upstream of the airflow meter 11.

Each cylinder includes an exhaust port 13 joined with the other exhaust ports 13 to form a single exhaust passage 14. The exhaust passage 14 is provided with a particulate filter (so-called gasoline particulate filter, GPF) 15 for collecting exhaust particulates. In this example, the particulate filter 15 is made of a so-called sealing-type ceramic filter in which a large number of fine passages formed in a monolithic ceramic body each have an end alternately sealed, wherein the particulate filter 15 has a surface coated with a three-way catalyst.

For sensing an exhaust air fuel ratio, an air fuel ratio sensor 19 is disposed upstream of the particulate filter 15 in the exhaust passage 14. Optionally, a separate three-way catalytic converter may be provided in series with the particulate filter 15.

The particulate filter 15 is provided with a pressure sensor unit 16 for sensing an upstream-to-downstream differential pressure of the particulate filter 15. The pressure sensor unit 16 is composed of an upstream pressure sensor 16A and a downstream pressure sensor 16B arranged within a package. In this example, the upstream pressure sensor 16A and the downstream pressure sensor 16B are semiconductor pressure sensors whose types are suitably selected. Basically, the upstream pressure sensor 16A and the downstream pressure sensor 16B are implemented by pressure sensors identical to each other. A for-upstream-sensor pipe 17 branches off from a section of the exhaust passage 14 on the upstream side (inlet side) of the particulate filter 15, and is connected to the upstream pressure sensor 16A, such that exhaust pressure upstream of the particulate filter 15 is guided to the upstream pressure sensor 16A via this for-upstream-sensor pipe 17. A for-downstream-sensor pipe 18 branches off from a section of the exhaust passage 14 on the downstream side (outlet side) of the particulate filter 15, and is connected to the downstream pressure sensor 16B, such that exhaust pressure downstream of the particulate filter 15 is guided to the downstream pressure sensor 16B via this for-downstream-sensor pipe 18. In this embodiment, due to a location where the pressure sensor unit 16 is mounted, the for-upstream-sensor pipe 17 and the for-downstream-sensor pipe 18 are different in path length from each other. In this example, the path length of the for-upstream-sensor pipe 17 is relatively shorter. As described below, the difference in path length causes a phase difference between a pressure waveform sensed by the upstream pressure sensor 16A and a pressure waveform sensed by the downstream pressure sensor 16B.

Sensing signals are inputted from the upstream pressure sensor 16A and the downstream pressure sensor 16B to the engine controller 9. The engine controller 9 further receives input of sensing signals from the airflow meter 11 and the air-fuel ratio sensor 19, and also receives input of sensing signals from a number of other sensors and the like, such as a crank angle sensor 21 for sensing an engine speed, a water temperature sensor 22 for sensing a coolant temperature, and an accelerator opening sensor 23 for sensing an amount of depression of an accelerator pedal. Based on these input signals, the engine controller 9 optimally controls the amount and timing of fuel injection by the fuel injection valve 5, the ignition timing by the spark plug 4, the opening of the throttle valve 10, and others.

Furthermore, the engine controller 9 determines the upstream-to-downstream differential pressure of the particulate filter 15 based on the pressure sensing by the upstream pressure sensor 16A and the downstream pressure sensor 16B, and based on this differential pressure, controls a regeneration process against clogging of the particulate filter 15, and estimates damage to the particulate filter 15.

Specifically, when an excessive amount of particulates accumulate in the particulate filter 15, the airflow resistance of the particulate filter 15 increases, so that a forced regeneration process, for example, by temporarily increasing the exhaust temperature, is required. The increase in airflow resistance is sensed as an increase in the upstream-to-downstream differential pressure of the particulate filter 15. On the other hand, if a ceramic filter is damaged due to impact or the like, its performance in capturing exhaust particulates is adversely affected, and such a damage causes a relatively significant decrease in the airflow resistance. The decrease in the airflow resistance is sensed as a decrease in the upstream-to-downstream differential pressure of the particulate filter 15.

Figure 3:
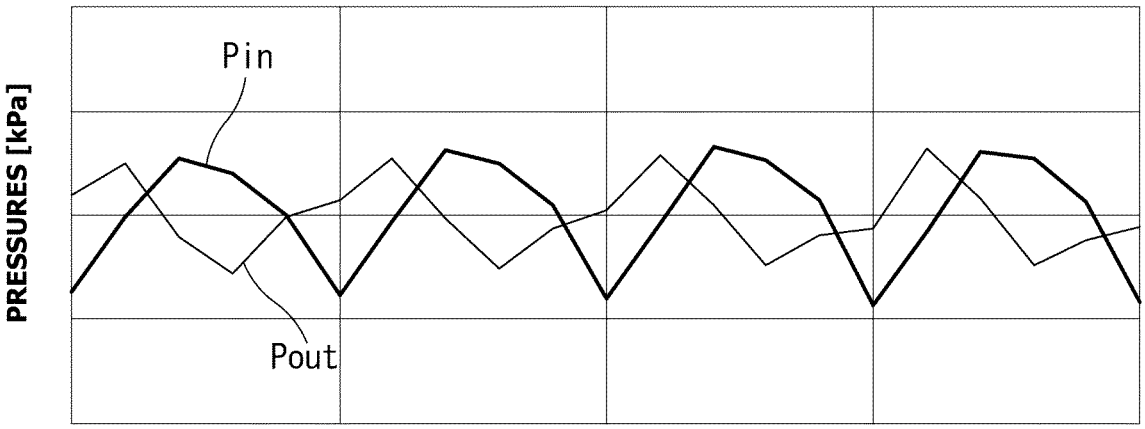
FIG. 3 is a characteristic diagram showing an upstream pressure waveform and a downstream pressure waveform according to a reference example in which no compensation is made for phase difference.

FIG. 3 shows a pressure waveform of an upstream pressure Pin sensed by the upstream pressure sensor 16A and a pressure waveform of a downstream pressure Pout sensed by the downstream pressure sensor 16B, wherein a horizontal axis represents a crank angle or time. As the exhaust valve 3 opens and closes for each cycle, exhaust pulsation occurs in the exhaust passage 14 with a period or frequency corresponding to the number of cylinders and the engine rotation speed. This exhaust pulsation appears both in the upstream pressure Pin and in the downstream pressure Pout. Since the path length of the for-upstream-sensor pipe 17 is shorter than the path length of the for-downstream-sensor pipe 18 as described above, a phase difference occurs wherein the pressure waveform of the upstream pressure Pin is relatively advanced. Such a phase difference causes a significant upstream-to-downstream differential pressure, and thereby adversely affects the accuracy of estimation of the state of clogging and estimation of filter damage based on the airflow resistance.

Figure 2:
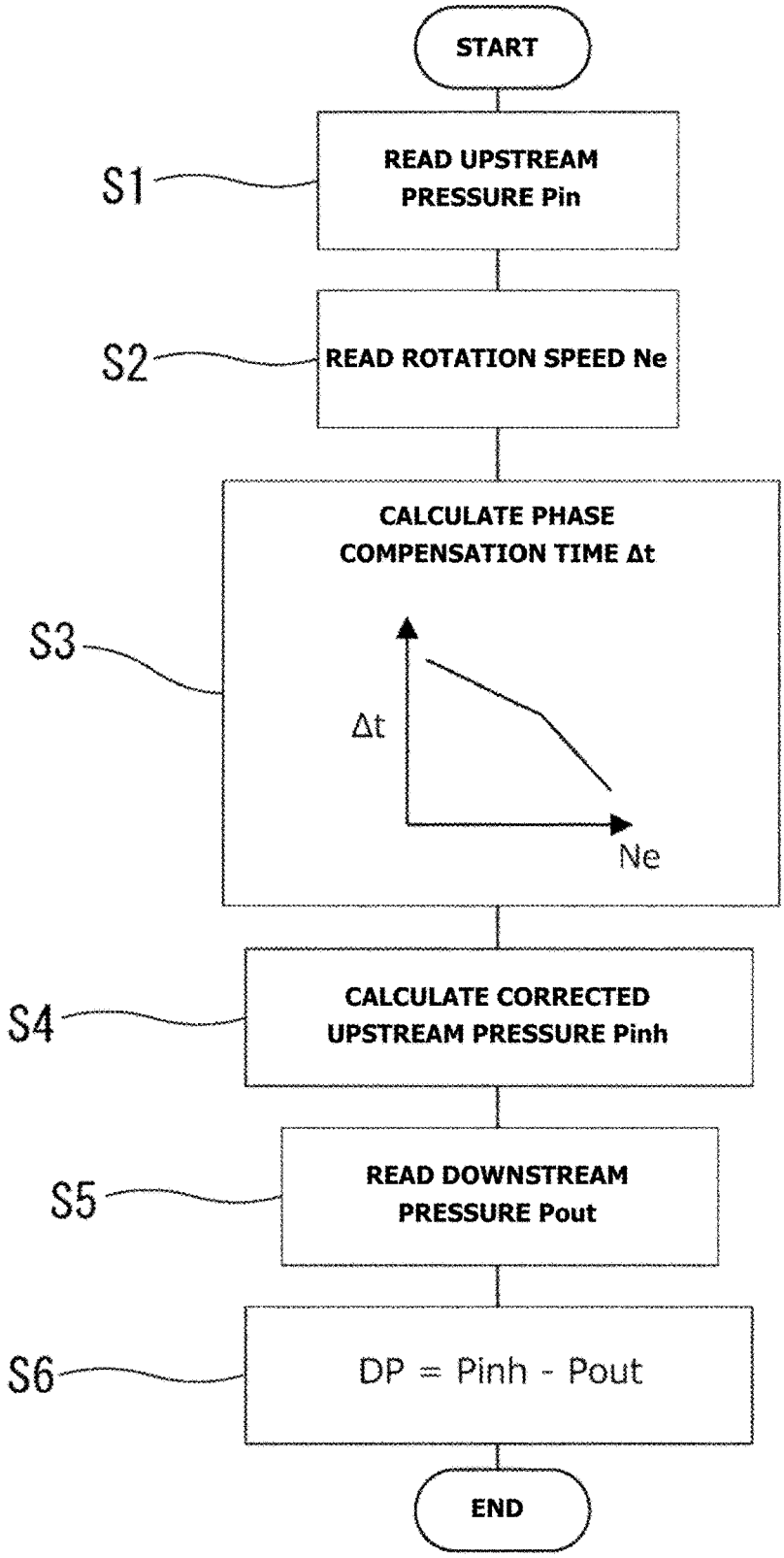
FIG. 2 is a flowchart showing a process for calculating an upstream-to-downstream differential pressure according to the embodiment.

In this embodiment, such a phase difference is compensated for in advance, and then the upstream-to-downstream differential pressure is calculated based on the upstream pressure Pin and the downstream pressure Pout. FIG. 2 is a flow chart showing a flow of a process for calculating the upstream-to-downstream differential pressure, which is executed by the engine controller 9. This process is repeatedly executed for each predetermined calculation cycle.

First, at Step 1, a sensed pressure value Pin of the upstream pressure sensor 16A at the moment is read. The reading of the sensed pressure value Pin is repeated for each calculation cycle, so that time-series data are obtained as the pressure waveform Pin shown in FIG. 3.

Next, at Step 2, the rotation speed Ne of the internal combustion engine 1 is read. Then, at Step 3, a phase compensation time $\Delta t$ corresponding to the phase difference is calculated based on the rotation speed Ne using a predetermined table or a predetermined relational expression. The phase compensation time $\Delta t$ has a characteristic that the phase compensation time $\Delta t$ is maximized when the rotation speed Ne is equal to an idle rotation speed, and gets shorter as the rotation speed Ne increases.

Next, at Step 4, a corrected upstream pressure Pinh is calculated. Specifically, a pressure value the phase compensation time $\Delta t$ before is obtained from the time series data of the upstream pressure Pin, which is obtained as the pressure waveform Pin in FIG. 3. Then, the corrected upstream pressure Pinh at the moment is set to this obtained pressure value.

Next, at Step 5, a sensed pressure value Pout of the downstream pressure sensor 16B at the moment is read. Then, at Step 6, the upstream-to-downstream differential pressure DP is calculated as a difference between the corrected upstream pressure Pinh and the downstream sensed pressure value Pout. Namely, the upstream-to-downstream differential pressure DP is calculated as "DP=Pinh−Pout".

Figure 4:
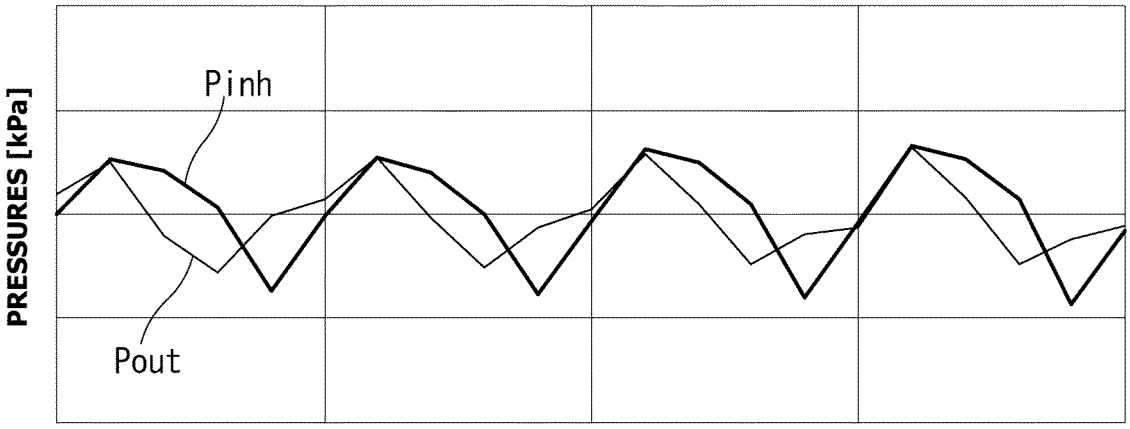
FIG. 4 is a characteristic diagram showing an upstream pressure waveform and a downstream pressure waveform according to the embodiment in which compensation is made for phase difference.

FIG. 4 shows a relationship between a pressure waveform of the corrected upstream pressure Pinh and the downstream pressure Pout. The corrected upstream pressure Pinh has a form produced by delaying the pressure waveform of the upstream pressure Pin shown in FIG. 3 by the phase compensation time Δt, wherein this correction reduces the phase difference therebetween. This serves to reduce the upstream-to-downstream differential pressure resulting from the phase difference, and thereby enhance the accuracy of estimation of clogging, etc. based on the upstream-to-downstream differential pressure. The upstream-to-downstream differential pressure DP calculated for each calculation cycle at Step 6 is subjected to a suitable averaging process, and then finally used for controlling the regeneration process of the particulate filter 15, etc.

In the embodiment described above, the phase difference is reduced by delaying the pressure waveform of the upstream pressure Pin that is relatively advanced. However, it may be modified such that both the pressure waveform of the upstream pressure Pin and the pressure waveform of the downstream pressure Pout are obtained in the form of time-series data, and then the downstream pressure Pout, which is relatively retarded, is corrected to be advanced. Furthermore, the phase difference may be reduced by correcting the upstream pressure Pin and the downstream pressure Pout to approach each other.

In the embodiment described above, the phase compensation time Δt is determined based on the engine speed Ne. However, a further correction based on an exhaust gas temperature may be applied to the phase compensation time Δt based on the engine speed Ne. As the exhaust gas temperature increases, the speed of sound increases so that the required phase compensation time Δt becomes shorter. It may be implemented by creating a map in advance in which optimal values of the phase compensation time Δt are assigned with respect to the engine speed Ne and the exhaust gas temperature as parameters, and reading the phase compensation time Δt from the map. The exhaust gas temperature may be sensed by using a temperature sensor, or may be estimated based on an operating state of the internal combustion engine 1 (load, rotation speed, etc.).

Furthermore, another correction based on an exhaust gas flow rate may be applied to the phase compensation time Δt based on the engine rotation speed Ne. As the exhaust gas flow rate increases, the flow velocity increases so that the required phase compensation time Δt becomes shorter. It may be implemented by creating a map in advance in which optimal values of the phase compensation time Δt are assigned with respect to the engine speed Ne and the exhaust gas flow rate as parameters, and reading the phase compensation time Δt from the map. For simplicity, the exhaust gas flow rate may be regarded as being equal to the intake air quantity, or may be calculated based on the intake air quantity while taking account of combustion.

Furthermore, the phase compensation time Δt based on the engine speed Ne may be corrected using both the exhaust gas temperature and the exhaust gas flow rate.

While the embodiment has been described above in which the present invention is applied to the gasoline particulate filter (GPF), the present invention may be also applied similarly to a diesel particulate filter (DPF) for a diesel engine.

Furthermore, in the embodiment described above, it has been described that the phase difference is caused by the difference in path length between the for-upstream-sensor pipe 17 and the for-downstream-sensor pipe 18. However, the phase difference may occur due to other factors, such as the influence of the exhaust passage volume. The present invention may be applied similarly to such cases.

The invention claimed is:

1. A particulate filter differential pressure sensing method comprising:

sensing by an upstream pressure sensor a first pressure on an upstream side of a particulate filter disposed in an exhaust passage of an internal combustion engine;

sensing by a downstream pressure sensor a second pressure on a downstream side of the particulate filter;

calculating an upstream-to-downstream differential pressure of the particulate filter;

correcting a sensed value of the first pressure or the second pressure so as to reduce a difference in waveform phase between the first pressure and the second pressure; and implementing the calculation of the upstream-to-downstream differential pressure based on the corrected sensed value of the first pressure or the second pressure;

wherein a first for-sensor pipe that branches from an exhaust pipe provided with the particulate filter and leads to the upstream pressure sensor and a second for-sensor pipe that branches from the exhaust pipe and leads to the downstream pressure sensor are different in path length from each other; and wherein the particulate filter differential pressure sensing method comprises calculating the corrected sensed value by retarding the sensed value of one of the upstream pressure sensor and the downstream pressure sensor corresponding to one of the first for-sensor pipe and the second for-sensor pipe that is shorter in path length than the other.

2. The particulate filter differential pressure sensing method as claimed in claim 1, comprising determining based on the calculated upstream-to-downstream differential pressure whether or not the particulate filter is damaged.

3. The particulate filter differential pressure sensing method as claimed in claim 1, comprising performing a control of regeneration of the particulate filter based on the calculated upstream-to-downstream differential pressure.

4. A particulate filter differential pressure sensing method comprising:

sensing by an upstream pressure sensor a first pressure on an upstream side of a particulate filter disposed in an exhaust passage of an internal combustion engine;

sensing by a downstream pressure sensor a second pressure on a downstream side of the particulate filter;

calculating an upstream-to-downstream differential pressure of the particulate filter;

correcting a sensed value of the first pressure or the second pressure so as to reduce a difference in waveform phase between the first pressure and the second pressure;

implementing the calculation of the upstream-to-downstream differential pressure based on the corrected sensed value of the first pressure or the second pressure;

calculating a phase compensation time period based on rotation speed of the internal combustion engine, wherein the phase compensation time period corresponds to the difference in waveform phase; and setting the corrected sensed value to a sensed value of one of the first pressure and the second pressure the phase compensation time period before, wherein the one of the first pressure and the second pressure is more advanced in waveform phase than the other.

5. The particulate filter differential pressure sensing method as claimed in claim 4, comprising:

calculating an exhaust gas temperature; and correcting the phase compensation time period based on the exhaust gas temperature.

6. The particulate filter differential pressure sensing method as claimed in claim 4, comprising:

calculating an exhaust gas flow rate; and correcting the phase compensation time period based on the exhaust gas flow rate.

7. The particulate filter differential pressure sensing method as claimed in claim 4, comprising determining based on the calculated upstream-to-downstream differential pressure whether or not the particulate filter is damaged.

8. The particulate filter differential pressure sensing method as claimed in claim 4, comprising performing a control of regeneration of the particulate filter based on the calculated upstream-to-downstream differential pressure.

9. A particulate filter differential pressure sensing device comprising:

an upstream pressure sensor structured to sense a first pressure on an upstream side of a particulate filter disposed in an exhaust passage of an internal combustion engine;

a downstream pressure sensor structured to sense a second pressure on a downstream side of the particulate filter;

a phase compensation section configured to correct a sensed value of the first pressure or the second pressure so as to reduce a difference in waveform phase between the first pressure and the second pressure; and a differential pressure calculation section configured to calculate an upstream-to-downstream differential pressure of the particulate filter based on the corrected sensed value of the first pressure or the second pressure;

wherein a first for-sensor pipe that branches from an exhaust pipe provided with the particulate filter and leads to the upstream pressure sensor and a second for-sensor pipe that branches from the exhaust pipe and leads to the downstream pressure sensor are different in path length from each other; and wherein the phase compensation section is configured to calculate the corrected sensed value by retarding the sensed value of one of the upstream pressure sensor and the downstream pressure sensor corresponding to one of the first for-sensor pipe and the second for-sensor pipe that is shorter in path length than the other.

10. A particulate filter differential pressure sensing device comprising:

an upstream pressure sensor structured to sense a first pressure on an upstream side of a particulate filter disposed in an exhaust passage of an internal combustion engine;

a downstream pressure sensor structured to sense a second pressure on a downstream side of the particulate filter;

a phase compensation section configured to correct a sensed value of the first pressure or the second pressure so as to reduce a difference in waveform phase between the first pressure and the second pressure; and a differential pressure calculation section configured to calculate an upstream-to-downstream differential pressure of the particulate filter based on the corrected sensed value of the first pressure or the second pressure;

wherein the phase compensation section is configured to:

calculate a phase compensation time period based on rotation speed of the internal combustion engine, wherein the phase compensation time period corresponds to the difference in waveform phase; and set the corrected sensed value to a sensed value of one of the first pressure and the second pressure the phase compensation time period before, wherein the one of the first pressure and the second pressure is more advanced in waveform phase than the other.

* * * * *